US006394508B1

(12) United States Patent
Zehrung

(10) Patent No.: US 6,394,508 B1
(45) Date of Patent: May 28, 2002

(54) ELECTRIFIED EMERGENCY EXIT DEVICE HAVING AN ACCESSIBLE HOLD OFF LOCK

(76) Inventor: Raymond E. Zehrung, 131 Serena Way, Santa Clara, CA (US) 95051

( * ) Notice: Subject to any disclaimer, the term of this patent is extended or adjusted under 35 U.S.C. 154(b) by 1 day.

(21) Appl. No.: 09/151,003

(22) Filed: Sep. 10, 1998

(51) Int. Cl.[7] ..... E05B 65/10

(52) U.S. Cl. ..... 292/92; 292/279; 292/DIG. 65; 70/92

(58) Field of Search ..... 292/92, 93, 21, 292/168, 166, 227, 221, 213–218, 279, 280; 70/92

(56) References Cited

U.S. PATENT DOCUMENTS

| | | | | | |
|---|---|---|---|---|---|
| 3,614,145 | A | | 10/1971 | Zawadzki | |
| 3,663,047 | A | | 5/1972 | Zawadzki | |
| 3,730,574 | A | | 5/1973 | Zawadzki | |
| 3,767,238 | A | | 10/1973 | Zawadzki | |
| 3,854,763 | A | | 12/1974 | Zawadzki et al. | |
| 4,083,590 | A | * | 4/1978 | Folger | 292/92 |
| 4,167,280 | A | | 9/1979 | Godec et al. | |
| 4,458,928 | A | | 7/1984 | Hirschbein | |
| 4,466,643 | A | | 8/1984 | Godec et al. | |
| 4,785,286 | A | * | 11/1988 | Martin | 292/92 |
| 4,801,163 | A | * | 1/1989 | Miller | 292/92 |
| 4,824,150 | A | * | 4/1989 | Smith et al. | 292/92 |
| 4,839,988 | A | * | 6/1989 | Betts et al. | 292/92 |
| 4,968,070 | A | * | 11/1990 | Choi | 292/92 |
| 4,976,476 | A | * | 12/1990 | Cross et al. | 292/92 |
| 5,011,199 | A | * | 4/1991 | Lowe et al. | 292/92 |
| 5,322,332 | A | * | 6/1994 | Toledo et al. | 292/92 |
| 5,490,696 | A | * | 2/1996 | Hutson | 292/92 |

OTHER PUBLICATIONS

3700/8700/8800 Rim Exit Device Owner's Manual, published 10/97 by Adams Rite Manufacturing Co., City of Industry, California.

8800 Rim Exit Device Preparation and Installation Instructions and Drawings For Aluminum Door, published 02/98 by Adams Rite Manufacturing Company, City of Industry, California.

3700EL/8700EL/8800/EL Rim Exit Devices With Electric Latch Retraction Installation Instructions and Troubleshooting Guide, published 10/97 by Adams Rite Manufacturing Company, City of Industry, California.

33/3547 Series Concealed Vertical Rod Device Installation Instructions, no publication date, published by Von Duprin, Inc. of Indianapolis, Indiana.

* cited by examiner

*Primary Examiner*—Teri Pham Luu
(74) *Attorney, Agent, or Firm*—David R. Gildea

(57) ABSTRACT

An electrified emergency exit device having a normally locked condition and having an operable hold off lock that is accessible from the emergency use side for maintaining an unlocked condition. The emergency exit device includes a star wheel door latch for locking or unlocking a door, a sliding catch having a lock position where the sliding catch is engaged to the door latch for locking the door and a free position where the sliding catch is disengaged from the door latch for unlocking the door, a push bar linkage operable from the emergency use side and coupled for sliding the sliding catch to the free position, a remotely operable solenoid coupled for sliding the sliding catch to the free position, the hold off lock coupled for maintaining the sliding catch in the free position, and a solenoid spring for biasing the solenoid for urging the sliding catch to the lock position when none of the push bar, solenoid, and hold off lock are actuated.

12 Claims, 2 Drawing Sheets

ELECTRIFIED EMERGENCY EXIT DEVICE HAVING AN ACCESSIBLE HOLD OFF LOCK

BACKGROUND OF THE INVENTION

1. Field of the Invention

The invention relates generally to emergency exit devices and more particularly to an emergency exit device for unlocking a door for an emergency using either a push bar or a remotely actuated solenoid and maintaining the unlocked condition with a mechanical hold off lock that is accessible from the emergency use side.

2. Description of the Prior Art

Emergency exit devices are well-known for locking a door while allowing a person to unlock the door in order to exit a building in an emergency. Such devices are necessary, for example, when a door should normally remain locked but must be available as an exit in case of a fire. In some installations the emergency exit device is also required to have a hold off lock that is accessible from the emergency use side of the associated door in order to retain the door in an unlocked condition.

A type of emergency exit device, termed a rim-type, mounts horizontally on one side of the door for locking the door while enabling a person on the same side to unlock the door by pushing on a push bar. Manually operated rim-type emergency exit devices have been in use for many years. However, these devices were limited by not being controllable from a remote location such as a security office. An early approach to solving the problem of remote control involved electrifying the emergency exit device with the use of a motor driven worm gear. However, the high cost, great weight, large power consumption, and the slow speed of the worm gear limited the desirability of this solution. Another example of an electrified rim-type emergency exit device is disclosed by Zawadzki in U.S. Pat. No. 3,767,238. Zawadzki teaches the use of a series of linkages driven by a spring and culminating in latch bolt that projects for locking a door. For remote control Zawadzki uses two solenoids, a hefty solenoid for counteracting the spring and pulling the linkages for retracting of the latch bolt and a smaller solenoid for tripping one of the linkages so that the latch bolt again projects. A similar electrified emergency exit device disclosed in U.S. Pat. No. 3,854,763 by Zawadzki et al. uses only one hefty solenoid for pulling the linkages and dispenses with the second smaller solenoid. The device disclosed in U.S. Pat. No. 3,854,763 also includes a manually operated dogging lock that is accessible from the emergency use side and operates on the solenoid armature for holding the linkages for retaining the bolt latch in the retracted position. Unfortunately, both of these electrified emergency exit devices are heavy and costly and require a large solenoid using a relatively large amount of electrical power to overcome the spring force and the friction and inertia due to the relatively heavy weight and complexity of the linkages that must be pulled.

Another example of a rim-type emergency exit device is disclosed in U.S. Pat. No. 4,458,928 by Hirschbein as a "Rim Type Panic Actuator" and incorporated herein by reference. The device described by Hirschbein shows a series of linkages for engaging or disengaging a star wheel that latches to a bar-type strike mounted on an associated door frame. A spring biases the linkages to a normal lock condition by engaging the star wheel to prevent it from turning. For an emergency use, the bias of the spring may be overcome by pushing against a spring-loaded push bar that is coupled for disengaging the sliding catch from the star wheel, thereby unlocking the door. An mechanical hold off lock is available from the emergency use side for dogging the linkages for maintaining the disengaged condition. The device using the star wheel door latch disclosed by Hirschbein is relatively simple, low cost, and light in weight. Unfortunately, it is limited by having no provision for remote access for unlocking the door. Presumably, to address this limitation an electrified emergency exit device using a solenoid was developed and sold under model names 3700EL/8700EL/8800EL by Adams Rite Manufacturing Company. Remote access to this device is provided by electrical wiring to the solenoid. When operated by an electrical current, the solenoid operates through a linkage to overcome the bias of the spring to disengage the star wheel for unlocking the door. Unfortunately, due to the linkage and the strength of the spring, the solenoid must be relatively large requiring special machining operations and needs a relatively high electrical current for actuation, thereby requiring heavier wires or a shorter distance to the remote access site. The EL models may be held in the unlocked condition with a lock. However, this lock is accessed through the door from the other side of the door and is not accessible from the emergency use side. Alternatively, a continuous current to the solenoid can be used to maintain the unlocked condition. Unfortunately, the owners of some installations consider the use of a continuous current wasteful and/or unreliable for simply maintaining an unlocked condition.

SUMMARY OF THE INVENTION

It is therefore an object of the present invention to provide a low cost electrified emergency exit device using a simple light weight linkage that is driven by a small, low power solenoid for remote access for unlocking a door and a mechanical hold off lock accessible from the emergency use side.

An emergency exit device of the present invention has a door mounting side for attachment on a door and an emergency use side opposite the door mounting side. In operation, the emergency exit device normally locks the door to an associated door frame. The device unlocks the door from the door frame in response to electrical power from a remote site or by a manual pushing force on the device from the emergency use side. The unlocked condition can be maintained with a hold off lock that is accessible from the emergency use side. Briefly, in a preferred embodiment, the emergency exit device includes a star wheel door latch for locking or unlocking the door, a sliding catch having a lock position where the sliding catch is engaged to the star wheel door latch for locking the door and a free position where the sliding catch is disengaged from the latch for unlocking the door, a push bar linkage operable from the emergency use side and coupled for sliding the sliding catch to the free position, a small low power solenoid including a plunger directly connected for sliding the sliding catch to the free position, the hold off lock coupled for retaining the sliding catch in the free position, and a solenoid spring for biasing the solenoid plunger for urging the sliding catch to the lock position when none of the push bar, solenoid, and hold off lock are actuated.

The advantages of the electrified emergency exit device of the present invention are that it is relatively simple and low in cost, requires low electrical power for remote access, and uses a mechanical hold off lock that is operable from the emergency use side for maintaining the door in an unlocked condition.

These and other objects and advantages of the present invention will no doubt become obvious to those of ordinary skill in the art after having read the following detailed description of the preferred embodiments which are illustrated in the various figures.

DETAILED DESCRIPTION OF THE PREFERRED EMBODIMENTS

Figure 1:
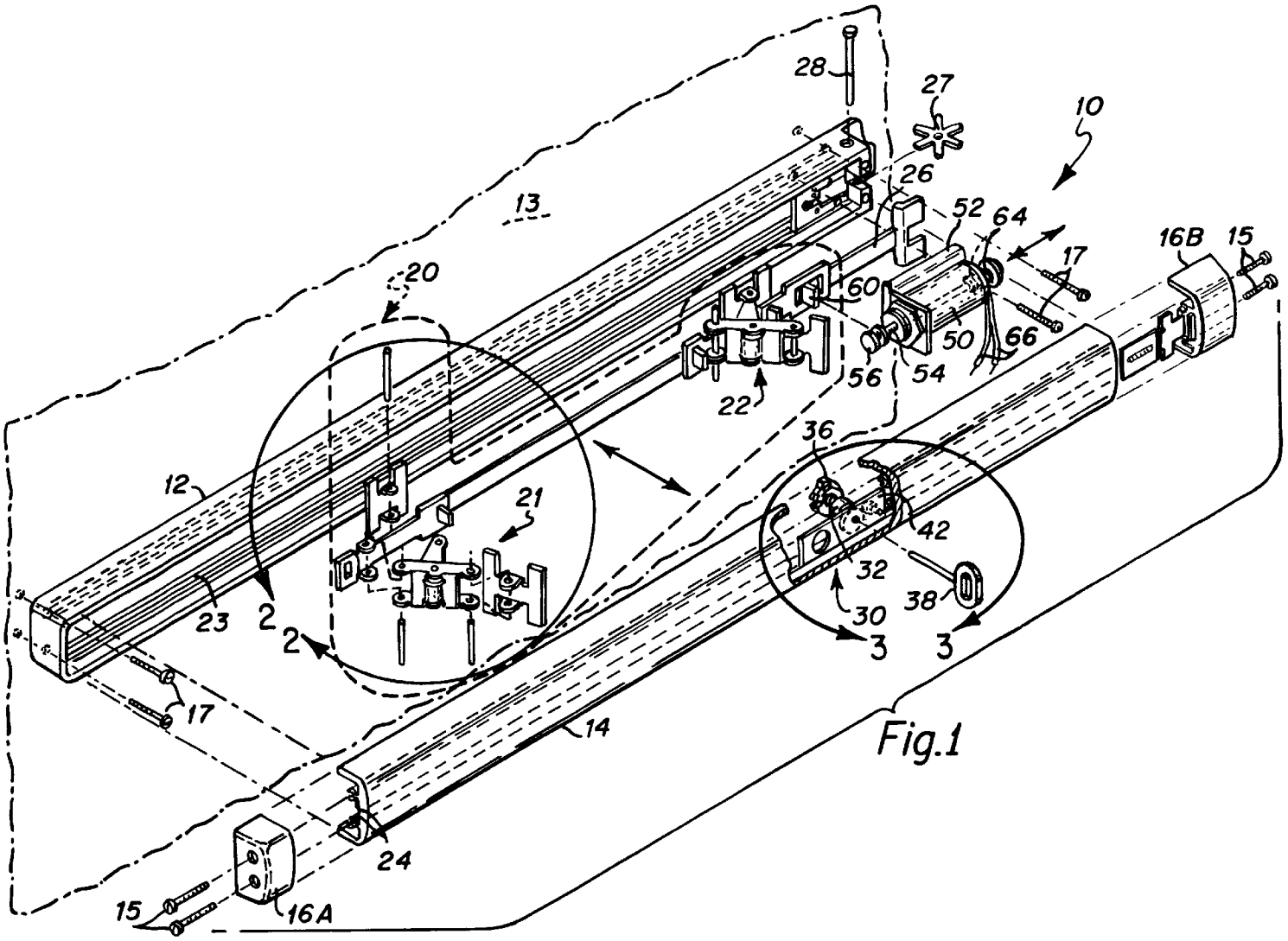
FIG. 1 is an assembly drawing of an emergency exit device of the present invention.

FIG. 1 is an assembly drawing of an emergency exit device of the present invention referred to by the general reference number 10. The emergency exit device 10 includes an elongated housing 12 for mounting horizontally on a door 13 and a coextensive exposed push bar 14. Screws 15 attach end caps 16*a* and 16*b* to the push bar 14. The housing 12 is attached to the door 13 with screws 17. The push bar 14 is supported over the housing 12 in an outward position by a spring-loaded push bar linkage 20 shown in FIG. 2 and described in the accompanying detailed description. The push bar linkage 20 including a first assembly 21 and a second assembly 22 is slidingly engaged to the housing 12 in longitudinal slots 23 and to the push bar 14 in longitudinal slots 24. A manual inward pushing force on the push bar 14 drives the push bar linkage 20 in an inward direction against the spring loading. The push bar linkage 20 converts the inward displacement from the push bar 14 to a longitudinal leftward displacement that is applied to a small, light weight sliding catch 26 made of a material such as aluminum. The sliding catch 26 is normally biased rightward to a lock position for engaging a star wheel door latch 27 to prevent the star wheel door latch 27 from turning on a pivot pin 28, thereby locking the door 13 to a bar-type strike of an associated door frame. The leftward displacement from the push bar linkage 20 disposes the sliding catch 26 leftward in a free position for disengaging the star wheel door latch 27, thereby unlocking the door 13.

Figure 3:
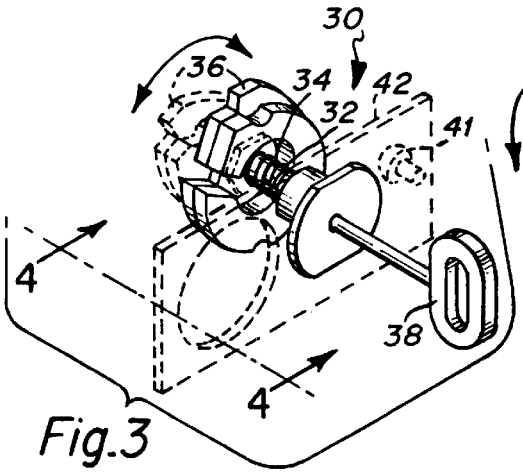
FIG. 3 is a drawing of a hold off lock of the emergency exit device of FIG. 1.
Figure 4:
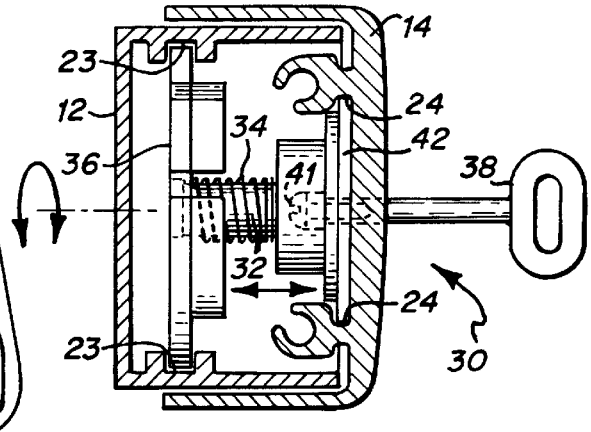
FIG. 4 is a cross-sectional drawing of the hold off lock of FIG. 3.

A manually operable hold off lock 30 including a shaft 32, a spring 34, and a dogging plate 36 mounts on the push bar 14 and is further illustrated in FIG. 3 as an enlarged view and in FIG. 4 as a cross-sectional view. The dogging plate 36 is rigidly attached to the shaft 32. When the push bar 14 is manually pushed and held fully inward, the shaft 32 can be turned with a key 38 so that the dogging plate 36 engages to the longitudinal slots 23 and holds or dogs the push bar 14 fully inward, thereby retaining the sliding catch 26 in the free position even when the manual push on the push bar 14 is afterward released. The push bar 14 will remain in the inward position until the key 38 is used to disengage the dogging plate 36 from the longitudinal slots 23, thereby giving a visual indication to even a casual observer that the emergency use device 10 is unlocked. The spring 34 adjusts for mechanical tolerances. The hold off lock 30 may be made so that the key 38 is a screw driver or a hex tool. A bolt 41 and bracket 42 attach the hold off lock 30 to the push bar 14.

A solenoid 50 mounts to the housing 12 with a bracket 52. The solenoid 50 includes a plunger 54 that is actuated by electrical power. The plunger 54 includes an H-shaped end 56 that directly engages a right angle projection 60 that is formed by bending the end of the sliding catch 26 that is opposite to the end that engages or disengages the star wheel door latch 27. Preferably, the H-shaped end 56 threads on the plunger 54 for adjusting the effective length of the plunger 54 to account for mechanical tolerances, especially those in the housing 12, bracket 52, sliding catch 26, and right angle projection 60. A substance such as loctite™ can be used to glue the H-shaped end 56 to the plunger 54 after the correct position is determined. A relatively weak coil type spring 64 in the solenoid 50 is used in compression for urging the plunger 54 and the sliding catch 26 in a rightward direction to the lock position for engaging the sliding catch 26 to the star wheel door latch 27. The solenoid 50 includes a rectifier for operation by an AC electrical power through wires 66 to draw the plunger 54 in a leftward direction, overcoming the bias of the spring 64 and driving the sliding catch 26 leftward to the free position. Of course, the directions right and left are reversed when the emergency exit device is turned around for mounting on a door that opens with the opposite rotation.

The direct connection of the plunger 54 of the solenoid 50 minimizes the required throw range of the plunger 54. The short throw range, the direct connection, and the light weight of the sliding catch 26 each contributes toward reducing the friction and inertia that must be overcome by the solenoid 50, thereby reducing the size and electrical current required by the solenoid 50 for operation. Moreover, the low friction and inertia enables the spring 64 to operate with a relatively low compression force further reducing the size and electrical current requirements for the solenoid 50. As a result the solenoid 50 actuates with a pull-in surge AC current of less than one Ampere and less than twenty-four Watts, preferably about three-hundred fifty milliamperes at about twenty-four volts for about eight or nine Watts, and holds with a continuous AC current of less than one-third Ampere and eight Watts, preferably about one-hundred milliamperes at about twenty-four volts for about two or three Watts.

Figure 2:
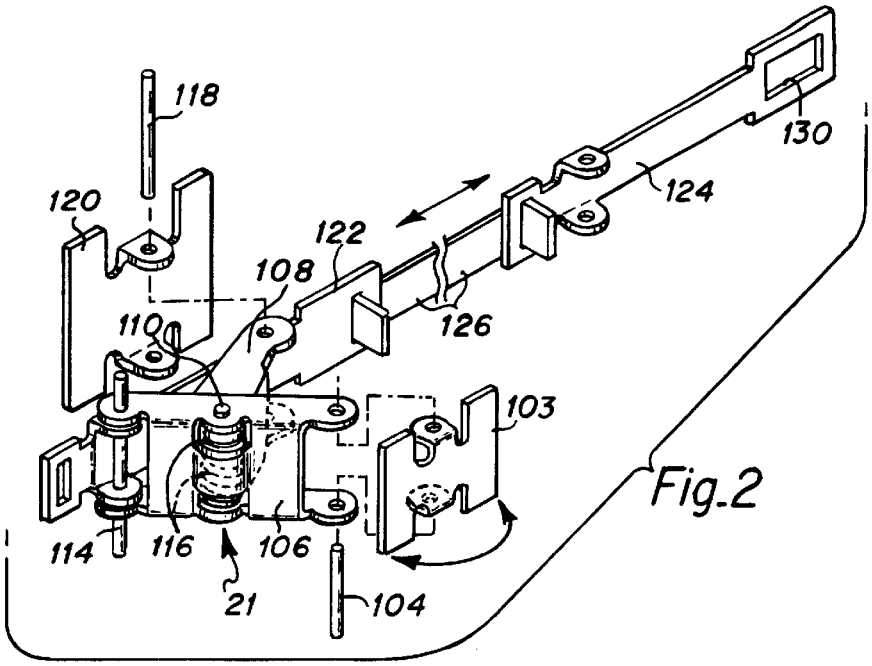
FIG. 2 is an assembly drawing of a push bar linkage of the emergency exit device of FIG. 1.

FIG. 2 is an assembly drawing of the spring loaded push bar linkage 20 showing the first assembly 21 and several linkages. The second assembly 22, shown in FIG. 1 but not repeated in FIG. 2, is identical to the first assembly 21. Each of the assemblies 21 and 22 includes a plate 103, a plate pivot pin 104, a push link 106, a radius link 108, a centrally located pivot pin 110, a sliding end pivot pin, 114, a push bar spring 116, a stationary pivot pin 118, and a bracket 120. The plate 103 is retained by the slots 24 (FIG. 1) on the underside of the push bar 14 (FIG. 1). The plate pivot pin 104 pivotally engages the plate 103 to the push link 106. The push link 106 pivotally engages to the radius link 108 through the centrally located pivot pin 110. The push bar spring 116 biases the push link 106 to rotate about the centrally located pivot pin 110 with respect to the radius link 108 for urging the plate 103 and the push bar 14 (FIG. 1) in the outward direction. The radius link 108 pivotally attaches to the housing 12 (FIG. 1) with the stationary pivot pin 118 and the bracket 120. The sliding pivot pin 114 slidingly engages the housing 12 (FIG. 1) in the slots 23 (FIG. 1). In the first assembly 21, the sliding pivot pin 114 pivotally engages a first sliding linkage 122. In the second assembly 22 (FIG. 1), the sliding pivot pin 114 pivotally engages a second sliding linkage 124. The first and second sliding linkages 122 and 124 are longitudinally connected by a third sliding linkage 126. The second sliding linkage 124 captures and encloses the right angle projection 60 (FIG. 1) of the sliding catch 26 (FIG. 1) within a planar enclosure 130.

Referring to FIGS. 1 and 2, both the first and second assemblies 21 and 22 operate in tandem with an inward pushing force on the push bar 14. The inward pushing force on the push bar 14 overcomes the bias of the push bar spring 116 and pushes the plate 103 inward, thereby pushing the outward end of the push link 106 in the inward direction driving the centrally located pivot pin 110 inward and leftward, decreasing the angle between the push link 106 and the radius link 108 and between the radius link 108 and the housing 12, and driving leftward the inward end of the push link 106 and the sliding pivot pin 114. The leftward displacement of the sliding pivot pin 114 pulls the first, second and third sliding linkages 122, 124, and 126 to the left. Then, when sufficient leftward displacement is obtained, the planar enclosure 130 of the second sliding linkage 124 engages the right angle projection 60 of the sliding catch 26 and pulls the plunger 54 leftward overcoming the bias of the spring 64. Continuing the leftward displacement of the sliding catch 26 against the urging of the spring 64 eventually disposes the sliding catch 26 in the free position and disengages the sliding catch 26 from the star wheel door latch 27, thereby unlocking the door 13.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An emergency exit device having a mounting side for attachment on a door and an opposed emergency use side, comprising:

a star wheel door latch for alternatively locking or unlocking said door;

a sliding catch formed in a single member having a lock position engaged directly to the star wheel door latch for locking said door and a free position disengaged from the star wheel door latch for unlocking said door;

a solenoid having a plunger engaged directly to the sliding catch for sliding the sliding catch to said free position in response to electrical power; and a push bar linkage operable from said emergency use side and coupled to the sliding catch for sliding the sliding catch to said free position in response to an inward pushing force.

2. The device of claim 1, further comprising:

a hold off lock operable from said emergency use side and coupled for holding the sliding catch in said free position.

3. The device of claim 1, wherein:

said plunger includes an end fitting having a longitudinally adjustable position on said plunger for said direct engagement to said sliding catch.

4. The device of claim 1, wherein:

the solenoid includes a spring on said plunger for urging the sliding catch to said lock position.

5. The device of claim 1, wherein:

said electrical power requires a surge power of less than about twenty-four Watts for sliding said sliding catch to said free position.

6. The device of claim 1, wherein:

said electrical power requires a continuous power of less than about eight Watts for holding said sliding catch in said free position.

7. A method for alternatively locking or unlocking a door in an emergency exit device having an emergency use side, comprising steps of;

providing a sliding catch formed in a single member, said sliding catch having a lock position and a free position;

engaging a first end of said sliding catch in said lock position directly to a star wheel door latch, said star wheel door latch for locking said door when engaged by said first end;

coupling a push bar linkage to said sliding catch for sliding said sliding catch from said locked position to said free position for disengaging said first end from said star wheel door latch in response to an inward pushing force of said push bar linkage, said star wheel door latch for unlocking said door when disengaged from said first end;

engaging a second end of said sliding catch directly to a plunger of a solenoid; and operating said plunger in response to a change in electrical power for sliding said sliding catch to said free position for disengaging said first end from said star wheel door latch.

8. The method of claim 7, further comprising a step of:

operating a hold off lock while said inward pushing force is being applied for retaining said sliding catch in said free position after said inward pushing force is released.

9. The method of claim 7, further comprising a step of:

adjusting a length of said plunger to a plunger end for engagement to said sliding catch.

10. The method of claim 7, further comprising steps of:

biasing said plunger with a spring on said plunder for urging said sliding catch to said lock position.

11. The method of claim 7, wherein:

the step of operating said plunger requires a surge power of less than about twenty-four Watts for sliding said sliding catch to said free position.

12. The method of claim 7, wherein:

the step of operating said plunger requires a continuous power of less than about eight Watts for holding said sliding catch in said free position.

* * * * *